US006890171B2

(12) United States Patent
Stephens et al.

(10) Patent No.: US 6,890,171 B2
(45) Date of Patent: May 10, 2005

(54) APPARATUS FOR OPTIMIZING BURNER PERFORMANCE

(75) Inventors: George Stephens, Humble, TX (US); David B. Spicer, Houston, TX (US); James H. Belt, Baytown, TX (US); Robert Trimble, Sand Springs, OK (US)

(73) Assignee: ExxonMobil Chemical Patents, Inc., Houston, TX (US)

( * ) Notice: Subject to any disclaimer, the term of this patent is extended or adjusted under 35 U.S.C. 154(b) by 84 days.

(21) Appl. No.: 10/388,991

(22) Filed: Mar. 14, 2003

(65) Prior Publication Data

US 2004/0018462 A1 Jan. 29, 2004

Related U.S. Application Data

(60) Provisional application No. 60/365,223, filed on Mar. 16, 2002.

(51) Int. Cl.[7] ..... F23C 5/00; F23D 11/00

(52) U.S. Cl. ..... 431/8; 431/159; 431/115

(58) Field of Search ..... 431/115, 5, 8, 431/9, 159, 187, 215, 349; 126/91 A

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,918,117 | A | 12/1959 | Griffin |
| 2,983,312 | A | 5/1961 | Finley et al. |
| 3,880,570 | A | 4/1975 | Marshall |
| 4,004,875 | A | 1/1977 | Zink et al. |
| 4,089,629 | A | 5/1978 | Baumgartner et al. |
| 4,130,388 | A | 12/1978 | Flanagan |
| 4,230,445 | A | 10/1980 | Janssen |
| 4,257,763 | A | 3/1981 | Reed |
| 4,575,332 | A | 3/1986 | Oppenberg et al. |
| 4,629,413 | A | 12/1986 | Michelson et al. |
| 4,708,638 | A | 11/1987 | Brazier et al. |
| 4,739,713 | A | 4/1988 | Vier et al. |
| 4,748,919 | A | 6/1988 | Campobenedetto et al. |

(Continued)

FOREIGN PATENT DOCUMENTS

| | | |
|---|---|---|
| CA | 1169753 | 6/1984 |
| DE | 2944153 | 5/1981 |
| DE | 3232421 | 3/1984 |
| DE | 3818265 | 11/1989 |
| EP | 0099828 | 6/1988 |

(Continued)

OTHER PUBLICATIONS

Straitz III, John F., et al., "Combat $NO_x$ With Better Burner Design," *Chemical Engineering*, Nov. 1994, pp. EE–4–EE–8.

(Continued)

*Primary Examiner*—Alfred Basichas

(57) ABSTRACT

An improved burner and a method for combusting fuel in burners used in furnaces such as those found in steam cracking. The burner includes a burner tube having a downstream end and an upstream end for receiving fuel and air, flue gas or mixtures thereof, a fuel orifice located adjacent the upstream end of the burner tube, for introducing fuel into the burner tube, a burner tip mounted on the downstream end of the burner tube and adjacent a first opening in the furnace, the burner tip having a plurality of air flow notches positioned about an outer periphery thereof, a peripheral tile surrounding the outer periphery of the burner tip, forming the first opening in the furnace, and a burner tip seal in contact with at least a portion of the outer periphery of the burner tip and the peripheral tile, wherein a plurality of air gaps is formed between an inner periphery of the burner tip seal and the air flow notches, the plurality of air gaps effective for providing a portion of the air for combustion.

29 Claims, 10 Drawing Sheets

U.S. PATENT DOCUMENTS

| | | | | | |
|---|---|---|---|---|---|
| 4,815,966 | A | | 3/1989 | Janssen | |
| 4,828,483 | A | | 5/1989 | Finke | |
| 4,963,089 | A | | 10/1990 | Spielman | |
| 4,995,807 | A | | 2/1991 | Rampley et al. | |
| 5,044,931 | A | | 9/1991 | Van Eerden et al. | |
| 5,073,105 | A | | 12/1991 | Martin et al. | |
| 5,092,761 | A | | 3/1992 | Dinocolantonio | |
| 5,098,282 | A | | 3/1992 | Schwartz et al. | |
| 5,135,387 | A | | 8/1992 | Martin et al. | |
| 5,152,463 | A | | 10/1992 | Mao et al. | |
| 5,154,596 | A | | 10/1992 | Schwartz et al. | |
| 5,195,884 | A | | 3/1993 | Schwartz et al. | |
| 5,201,650 | A | | 4/1993 | Johnson | |
| 5,224,851 | A | | 7/1993 | Johnson | |
| 5,238,395 | A | | 8/1993 | Schwartz et al. | |
| 5,254,325 | A | * | 10/1993 | Yamasaki et al. | 423/450 |
| 5,263,849 | A | | 11/1993 | Irwin et al. | |
| 5,269,679 | A | | 12/1993 | Syska et al. | |
| 5,275,554 | A | | 1/1994 | Faulkner | |
| 5,284,438 | A | | 2/1994 | McGill et al. | |
| 5,299,930 | A | | 4/1994 | Weidman | |
| 5,316,469 | A | | 5/1994 | Martin et al. | |
| 5,326,254 | A | | 7/1994 | Munk | |
| 5,344,307 | A | | 9/1994 | Schwartz et al. | |
| 5,350,293 | A | | 9/1994 | Khinkis et al. | |
| 5,370,526 | A | | 12/1994 | Buschulte et al. | |
| 5,407,345 | A | | 4/1995 | Robertson et al. | |
| 5,413,477 | A | | 5/1995 | Moreland | |
| 5,470,224 | A | | 11/1995 | Bortz | |
| 5,472,341 | A | | 12/1995 | Meeks | |
| 5,542,839 | A | | 8/1996 | Kelly | |
| 5,562,438 | A | | 10/1996 | Gordon et al. | |
| 5,584,684 | A | | 12/1996 | Dobbeling et al. | |
| 5,603,906 | A | | 2/1997 | Lang et al. | |
| 5,611,682 | A | | 3/1997 | Slavejkov et al. | |
| 5,624,253 | A | | 4/1997 | Sulzhik et al. | |
| 5,685,707 | A | * | 11/1997 | Ramsdell et al. | 431/90 |
| 5,688,115 | A | * | 11/1997 | Johnson | 431/9 |
| 5,807,094 | A | | 9/1998 | Sarv | |
| 5,813,846 | A | * | 9/1998 | Newby et al. | 431/9 |
| 5,980,243 | A | | 11/1999 | Surbey et al. | |
| 5,984,665 | A | | 11/1999 | Loftus et al. | |
| 5,987,875 | A | | 11/1999 | Hilburn et al. | |
| 5,993,193 | A | | 11/1999 | Loftus et al. | |
| 6,007,325 | A | | 12/1999 | Loftus et al. | |
| 6,056,538 | A | | 5/2000 | Büchner et al. | |
| 6,332,408 | B2 | * | 12/2001 | Howlett et al. | 110/189 |
| 6,347,935 | B1 | | 2/2002 | Schindler et al. | |
| 6,383,462 | B1 | * | 5/2002 | Lang | 423/235 |
| 6,616,442 | B2 | | 9/2003 | Venizelos et al. | |

FOREIGN PATENT DOCUMENTS

| | | |
|---|---|---|
| EP | 0 347 956 | 12/1989 |
| EP | 0 374 423 | 6/1990 |
| EP | 0 408 171 A1 | 1/1991 |
| EP | 0507233 | 10/1992 |
| EP | 0 620 402 A1 | 10/1994 |
| EP | 0 674 135 B2 | 9/1995 |
| EP | 0 751 343 | 1/1997 |
| EP | 0486169 | 1/1998 |
| EP | 1096202 | 2/2001 |
| EP | 1211458 | 6/2002 |
| FR | 2629900 | 10/1988 |
| SU | 374488 | 5/1970 |

OTHER PUBLICATIONS

Vahdati, M. M., et al., "Design And Development of A Low $No_x$ Conanda Ejector Burner," *Journal of the Institute of Energy*, Mar. 2000, vol. 73, pp. 12–17.

Bussman, Wes, et al., "Low $NO_x$ Burner Technology for Ethylene Cracking Furnaces," presented at the *2001 AIChE Spring National Meeting, 13th Annual Ethylene Producers Conference*, Houston, TX, Apr. 25, 2001, pp. 1–23.

Seebold, James G., "Reduce Heater $NO_x$ in the Burner," *Hydrocarbon Processing*, Nov. 1982, pp. 183–186.

"West Germany's Caloric Develops a Low–$NO_x$ Recycling Fuel Burner," *Chemical Engineering*, Oct. 4, 1982, p. 17.

Chemical Engineering Progress, vol. 43, 1947, "The Design of Jet Pumps" by A. Edgar Kroll, pp. 21–24, vol. 1, No. 2.

* cited by examiner

APPARATUS FOR OPTIMIZING BURNER PERFORMANCE

RELATED APPLICATIONS

This patent application claims priority from Provisional Application Ser. No. 60/365,223, Burner Tip for Pre-Mix Burners, filed on Mar. 16, 2002, the contents of which are hereby incorporated by reference.

FIELD OF THE INVENTION

This invention relates to an improvement in a burner of the type employed in high temperature industrial furnaces. More particularly, it relates to an improved burner tip design capable of achieving a reduction in $NO_x$ emissions.

BACKGROUND OF THE INVENTION

As a result of the interest in recent years to reduce the emission of pollutants from burners of the type used in large industrial furnaces, significant improvements have been made in burner design. In the past, burner design improvements were aimed primarily at improving heat distribution. Increasingly stringent environmental regulations have shifted the focus of burner design to the minimization of regulated pollutants.

Oxides of nitrogen ($NO_x$) are formed in air at high temperatures. These compounds include, but are not limited to, nitrogen oxide and nitrogen dioxide. Reduction of $NO_x$ emissions is a desired goal to decrease air pollution and meet government regulations.

The rate at which $NO_x$ is formed is dependent upon the following variables: (1) flame temperature, (2) residence time of the combustion gases in the high temperature zone and (3) excess oxygen supply. The rate of formation of $NO_x$ increases as flame temperature increases. However, the reaction takes time and a mixture of nitrogen and oxygen at a given temperature for a very short time may produce less $NO_x$ than the same mixture at a lower temperature, over a longer period of time.

Strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763. Also, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

One technique for reducing $NO_x$ that has become widely accepted in industry is known as combustion staging. With combustion staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Combustion staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

The majority of recent low $NO_x$ burners for gas-fired industrial furnaces is based on the use of multiple fuel jets in a single burner. Such burners may employ fuel staging, flue-gas recirculation, or a combination of both. U.S. Pat. Nos. 5,098,282 and 6,007,325 disclose burners using a combination of fuel-staging and flue-gas recirculation. Certain burners may have as many as 8–12 fuel nozzles in a single burner. The large number of fuel nozzles requires the use of very small diameter nozzles. In addition, the fuel nozzles of such burners are generally exposed to the high temperature flue-gas in the firebox.

In the high temperature environment of steam-cracking furnaces used for the manufacture of ethylene, the combination of small diameter fuel nozzles and exposure to high temperature flue gas can lead to fouling and potential plugging of the fuel jets. This not only has an adverse impact on burner performance, but also increases the cost of maintenance associated with repeated cleaning of fuel nozzles.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

U.S. Pat. No. 4,629,413 discloses a low $NO_x$ premix burner and discusses the advantages of premix burners and methods to reduce $NO_x$ emissions. The premix burner of U.S. Pat. No. 4,629,413 lowers $NO_x$ emissions by delaying the mixing of secondary air with the flame and allowing some cooled flue gas to recirculate with the secondary air.

The contents of U.S. Pat. No. 4,629,413 are incorporated by reference in their entirety.

U.S. Pat. No. 5,092,761 discloses a method and apparatus for reducing $NO_x$ emissions from premix burners by recirculating flue gas. Flue gas is drawn from the furnace through a pipe or pipes by the inspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The flue gas recirculating system may be retrofitted into existing premix burners or may be incorporated in new low $NO_x$ burners. The contents of U.S. Pat. No. 5,092,761 are incorporated by reference in their entirety.

An advantage of the staged-air pre-mix burners disclosed in U.S. Pat. Nos. 4,629,413 and 5,092,761 relates to their use of a single fuel nozzle. This permits the size of the fuel nozzle to be the maximum possible for a given burner firing duty. In addition, since the fuel nozzle is located at the inlet to the venturi, it is not exposed directly to either the high temperature flue-gas or the radiant heat of the firebox. For these reasons the problems of fuel nozzle fouling are minimized, providing a significant advantage for the staged-air pre-mix burner in ethylene furnace service.

An additional challenge to the designer of low NOx burners is to maintain adequate flame stability. The very techniques used to minimize NOx emissions reduce flame temperature and flame speed, and generally lead to less stable flames that are more prone to "lift-off." "Lift-off" is a term used to describe a flame where the zone of combustion has left the burner tip. In extreme cases, lift-off can lead to instances of flame-out; where combustion at the burner is extinguished. Such a condition is highly undesirable as it can potentially lead to an accumulation of an air/fuel mixture in the firebox.

From the standpoint of $NO_x$ production, a drawback has been discovered which is associated with the burner tip of the burner of U.S. Pat. No. 5,092,761. One drawback relates to the inability to precisely distribute air flow adjacent to the burner tip which can result in localized sources of high $NO_x$ production.

Despite these advances in the art, a need exists for a highly efficient burner design for industrial use to meet increasingly stringent $NO_x$ emission regulations, which minimizes localized sources of high $NO_x$ production.

Therefore, what is needed is a burner for the combustion of fuel and air wherein localized sources of high $NO_x$ production are substantially eliminated, yielding further reductions in $NO_x$ emissions.

SUMMARY OF THE INVENTION

The present invention is directed to an improved burner and a method for combusting fuel in burners used in furnaces such as those found in steam cracking. The burner includes a burner tube having a downstream end and an upstream end for receiving fuel and air, flue gas or mixtures thereof, a fuel orifice located adjacent the upstream end of the burner tube, for introducing fuel into the burner tube, a burner tip mounted on the downstream end of the burner tube and adjacent a first opening in the furnace, the burner tip having a plurality of air flow notches positioned about an outer periphery thereof, a peripheral tile surrounding the outer periphery of the burner tip, forming the first opening in the furnace; and a burner tip seal in contact with at least a portion of the outer periphery of the burner tip and the peripheral tile, wherein a plurality of air gaps is formed between an inner periphery of the burner tip seal and the air flow notches, the plurality of air gaps effective to provide a portion of the air for combustion.

The method of the present invention includes the steps of combining fuel and air, flue gas or mixtures thereof at a predetermined location adjacent a fuel orifice, passing the fuel and air, flue gas or mixtures thereof through a burner tube, discharging the fuel gas and air, flue gas or mixtures thereof at a burner tip downstream of the predetermined location, the burner tip having a plurality of air flow notches positioned about an outer periphery thereof, the burner tip peripherally surrounded by a peripheral tile, and sealing the outer periphery of the burner tip with a burner tip seal, the burner tip seal in sealing engagement with at least a portion of the outer periphery of the burner tip and the peripheral tile combusting the fuel gas downstream of the burner tip downstream of the predetermined location, wherein a plurality of air gaps are formed between an inner periphery of the burner tip seal and the air flow notches, the plurality of air gaps effective to provide a portion of the air for combustion.

The method of the present invention may also include the step of drawing a stream of flue gas from the furnace in response to the inspirating effect of uncombusted fuel exiting the fuel orifice and flowing towards the combustion zone, the flue gas mixing with the air at the predetermined location upstream of the zone of combustion.

An object of the present invention is to provide a burner configuration wherein localized sources of high $NO_x$ production are reduced, yielding further reductions in $NO_x$ emissions.

A further object of the present invention is to reduce a zone of high oxygen concentration adjacent to the burner tip, reducing $NO_x$ emissions.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF THE ILLUSTRATED EMBODIMENTS

Figure 1:
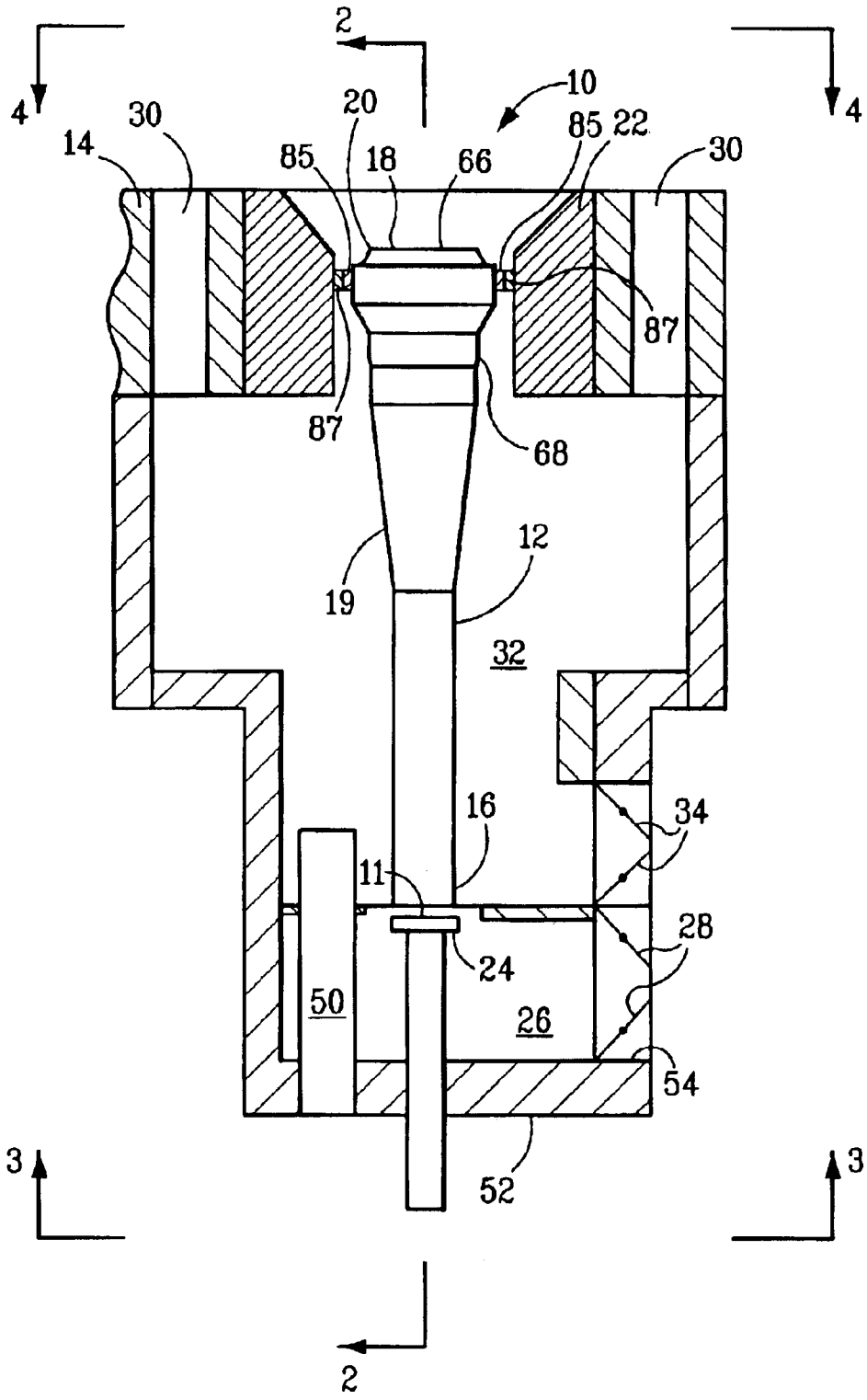
FIG. 1 illustrates an elevation partly in section of an embodiment of the burner of the present invention.

Reference is now made to the embodiments illustrated in FIGS. 1 through 12, wherein like numerals are used to designate like parts throughout.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring now to FIGS. 1 through 4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by a peripheral tile 22. Fuel orifice 11, which may be a gas spud such as gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion occurs downstream of burner tip 20.

Referring still to FIGS. 1 through 4, burner tip 20 has an upper end 66, which when installed, faces the furnace box, and a lower end 68 adapted for mating with the burner tube 12. Lower end 68 of burner tip 20 may be mated to burner tube 12 by welding, swaging or threaded engagement, with welding or threaded engagement being particularly preferred. In operation, side-ports 62 direct a fraction of the fuel gas across the face of peripheral tile 22, while main ports 64 direct the major portion of the fuel gas into the furnace. In a conventional burner tip, side ports are provided about the entire periphery of the outer edge of the burner tip.

A plurality of air ports 30 originates in secondary air chamber 32 and pass through furnace floor 14 into the furnace. Fresh air enters secondary air chamber 32 through adjustable dampers 34 and passes through staged air ports 30 into the furnace to provide secondary or staged combustion, as described in U.S. Pat. No. 4,629,413.

In order to recirculate flue gas from the furnace to the primary air chamber, ducts or pipes 36, 38 extend from openings 40, 42, respectively, in the floor of the furnace to openings 44, 46, respectively, in burner plenum 48. Flue gas containing, for example, about 0 to about 15% $O_2$ is drawn through pipes 36, 38 with about 5 to 15% $O_2$ preferred, about 2 to about 10% $O_2$ more preferred and about 2 to about 5% $O_2$ particularly preferred, by the inspirating effect of fuel gas passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. Closing or partially closing damper 28 restricts the amount of fresh air that can be drawn into the primary air chamber 26 and thereby provides the vacuum necessary to draw flue gas from the furnace floor 14.

Unmixed low temperature ambient air, having entered secondary air chamber 32 through dampers 34 and having passed through air ports 30 into the furnace, is also drawn through pipes 36, 38 into the primary air chamber by the inspirating effect of the fuel gas passing through venturi portion 19. The ambient air may be fresh air as discussed above. The mixing of the ambient air with the flue gas lowers the temperature of the hot flue gas flowing through pipes 36, 38 and thereby substantially increases the life of the pipes and permits use of this type of burner to reduce $NO_x$ emission in high temperature cracking furnaces having flue gas temperature above 1900° F. in the radiant section of the furnace.

It is preferred that a mixture of from about 20% to about 80% flue gas and from about 20% to about 80% ambient air should be drawn through pipes 36, 38. It is particularly preferred that a mixture of about 50% flue gas and about 50% ambient air be employed. The desired proportions of flue gas and ambient air may be achieved by proper sizing, placement and/or design of pipes 36, 38 in relation to air ports 30, as those skilled in the art will readily recognize. That is, the geometry of the air ports, including but not limited to their distance from the burner tube, the number of air ports, and the size of the air ports, may be varied to obtain the desired percentages of flue gas and ambient air.

Figure 2:
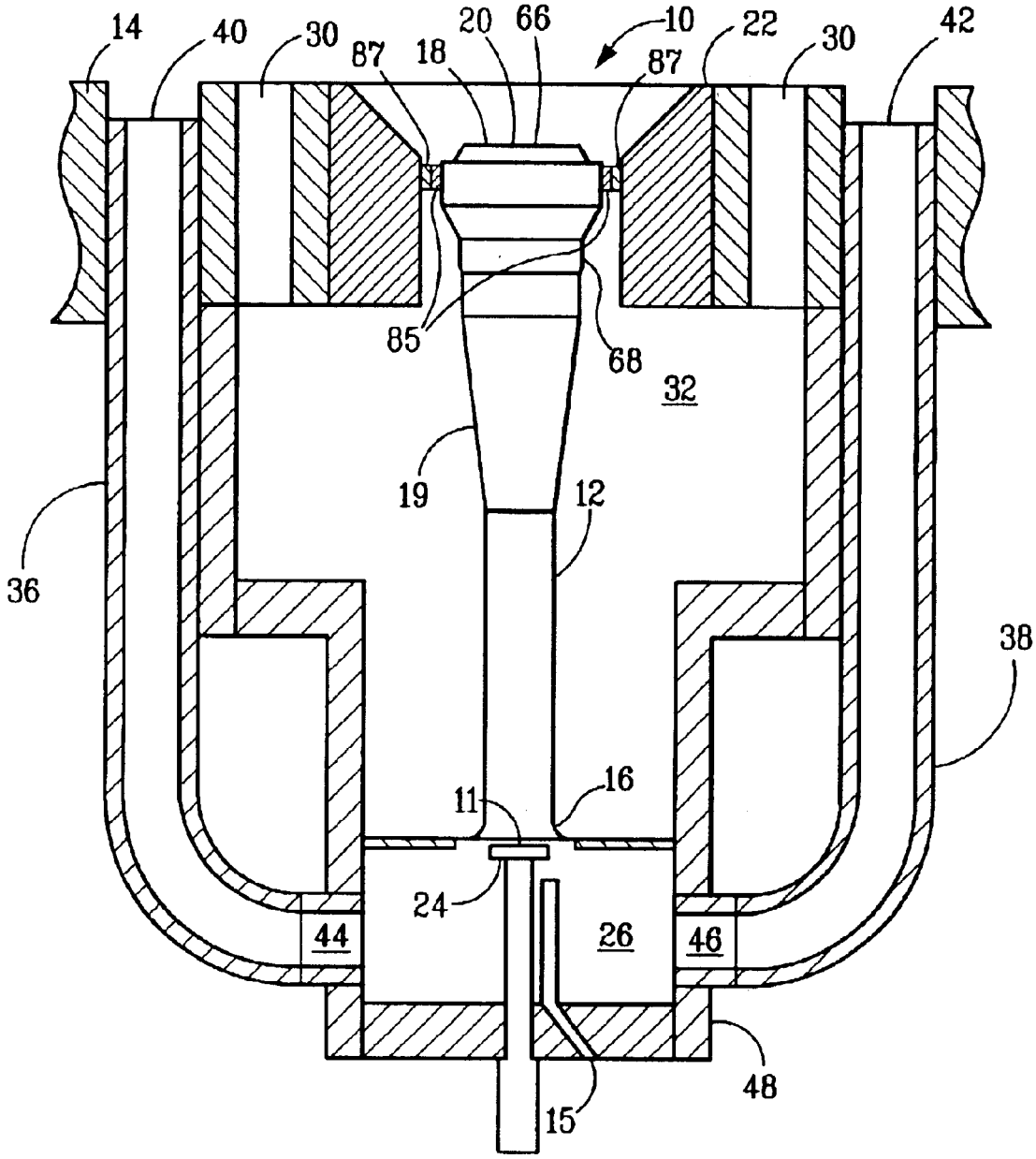
FIG. 2 is an elevation partly in section taken along line 2—2 of FIG. 1.
Figure 3:
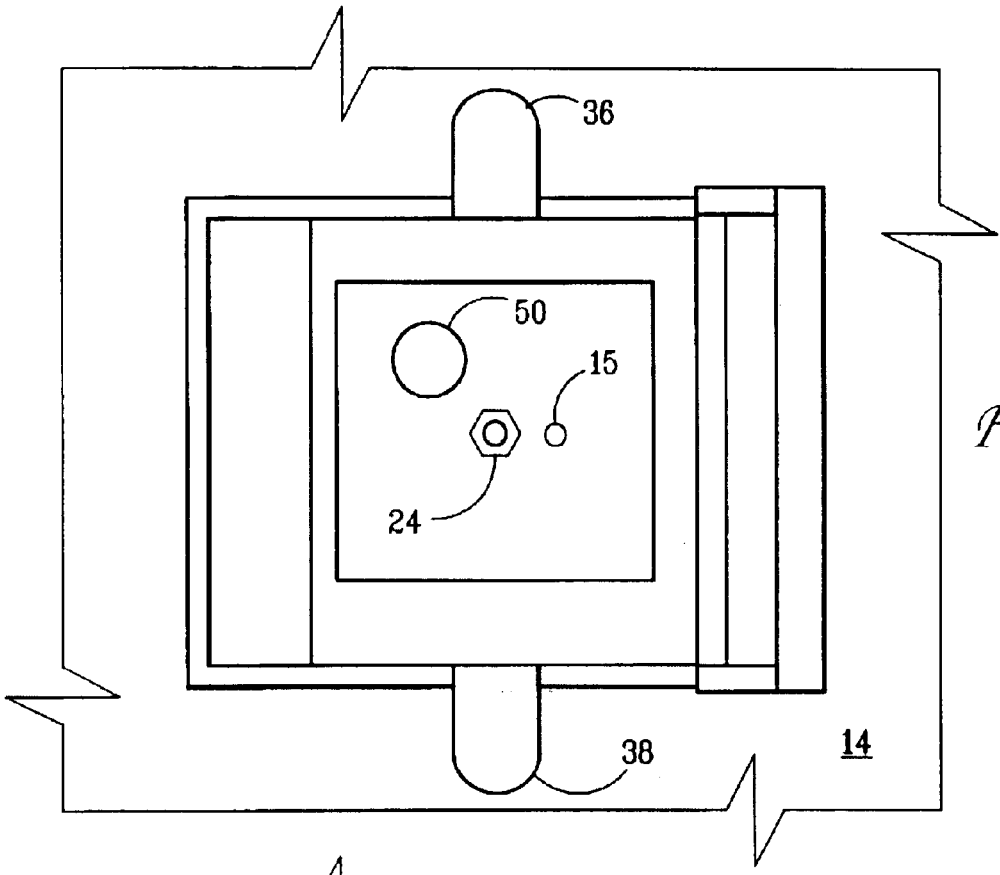
FIG. 3 is a plan view taken along line 3—3 of FIG. 1.
Figure 4:
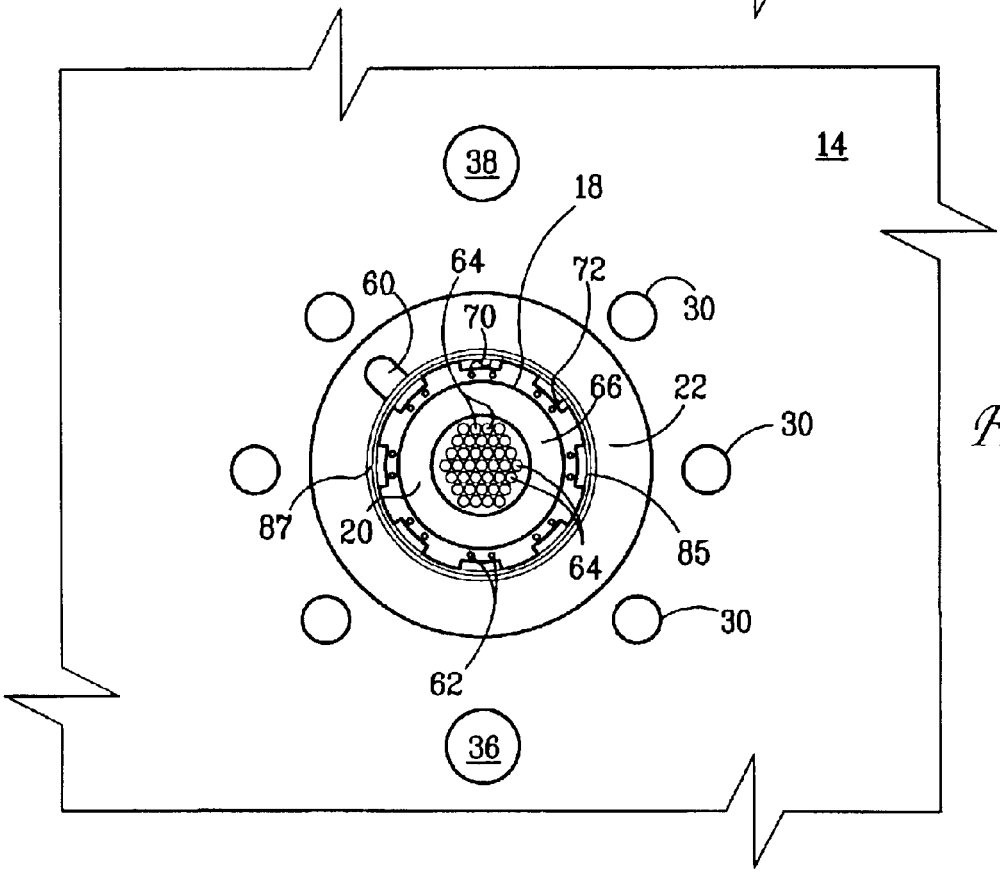
FIG. 4 is a plan view taken along line 4—4 of FIG. 1.
Figure 12A:
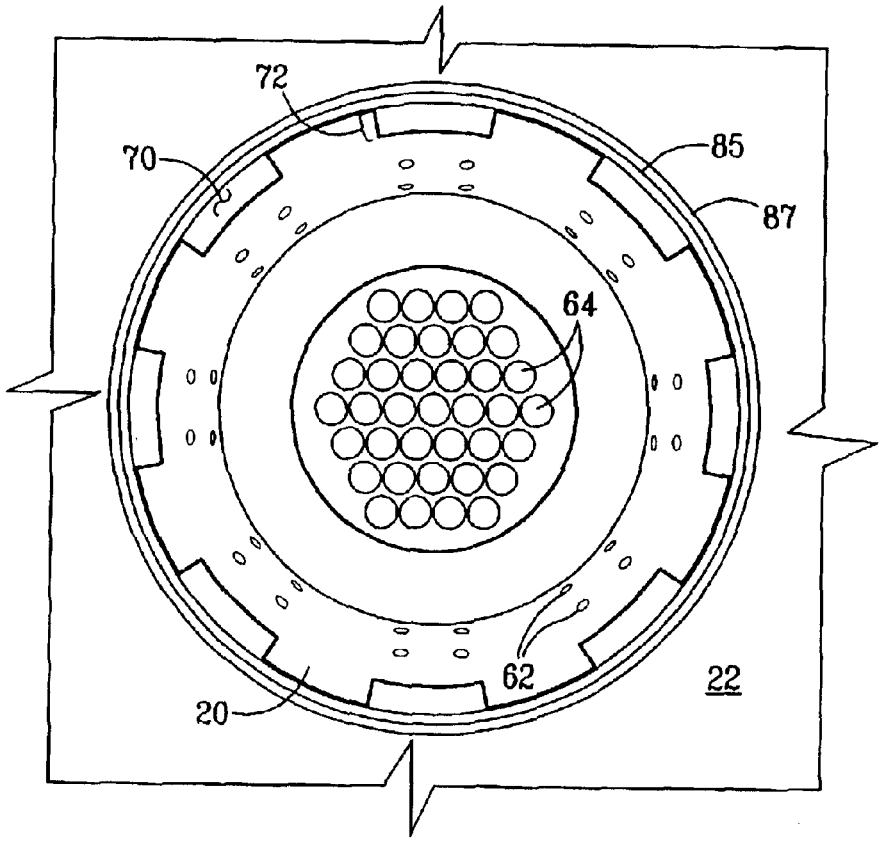
FIG. 12A is a top view of one embodiment of a burner tip seal for use in a burner of the type depicted in FIGS. 5–7.

As is shown in FIGS. 1, 2, 4, and in more detail in FIG. 12A, a plurality of air gaps 70 exist between the burner tip 20 and the burner tile 22. By properly engineering these gaps, the bulk of the secondary staged air is forced to enter the furnace through staged air ports 30 located some distance from the primary combustion zone, which is located immediately on the furnace side of the burner tip 20. These gaps may be a series of spaced gaps 70 peripherally arranged, as shown in FIG. 12A.

It has been discovered through testing that increasing the available flow area of the gap between the burner tip 20 and the peripheral burner tile 22 raises the overall $NO_x$ emissions produced by the burner, although it tends to also benefit flame stability. In view of its impact on $NO_x$ emissions, each gap between the burner tip 20 and the burner tile 22 must be correctly sized to maintain stability and minimize $NO_x$.

To optimize burner performance for low $NO_x$ emissions, the distance between the burner tip 20 and peripheral tile 22 must be held to a tight dimensional tolerance to ensure good air distribution around burner tip 20 and to minimize or significantly reduce unwanted air flow into the region. This unwanted air flow can cause the flames emanating from the side ports to be closer to stoichiometric conditions, tending to raise flame temperature and $NO_x$ levels.

As may be appreciated by those skilled in the art, the outer diameter of the burner tip 20 and the air flow notches 72 can be manufactured to relatively tight tolerances through investment casting or machining. However, the peripheral tile 22 is more difficult to manufacture to the same tolerances, creating an unwanted gap between the outer diameter of the burner tip 20 and the peripheral tile 22. Typically, a peripheral tile is poured into a mold using a castable refractory material. Compounding the problem of producing peripheral burner tiles to tight tolerances is the amount of shrinkage that the tiles experience when dried and fired. The amount of shrinkage varies according to material, temperature, and geometry, causing additional uncertainties in the final manufactured tolerances. These factors contribute to the difficulty in consistently manufacturing a tile to a specified diameter, which can lead to a tile that is too small in diameter or, more commonly, one that is too large in diameter.

While a potential solution is to manufacture the peripheral tile burner tip hole to a tighter tolerance, this requires that the peripheral tile's hole be machined, rather than cast. However, machining a hole in a conventional peripheral tile is difficult, time consuming and costly. Further, even if the tolerances are small during manufacturing, problems such as cracking of the ceramic material can occur due to differential thermal expansion between the metallic burner tip and the ceramic tile.

Referring to FIGS. 8A–C and 12A, to establish a uniform dimension between the burner tip 20 and the peripheral burner tile 22 for the air gaps 70, a burner tip band 85, which may be formed of steel or other metal or metal composite capable of withstanding the harsh environment of an industrial burner, is attached to the outer periphery of burner tip 20, by tack welding or other suitable means. Advantageously, a compressible high temperature material 87 is optionally employed in the unwanted gap between the burner tip band 85 and the peripheral tile 22 to further reduce or eliminate the gap. Burner tip band 85 may further include a peripheral indentation 81 (see FIG. 8A) or peripheral indentation 83 (see FIG. 8C), respectively, for seating said compressible high temperature material. An advantage of this novel design is that the peripheral tile hole size can vary significantly, while the compressible material can adjusted for this variance in order to maintain the seal between the burner tip 20 and peripheral tile 22. By using the burner tip designs of the present invention, the air gap between the burner tip and peripheral tile can be maintained to exacting tolerances, essentially eliminating unwanted air leakage.

As may be appreciated, compressible material 87 should be rated for high temperature service since it is very close to the burner side port flames. A material that expands when heated is very useful as compressible material 87 because it makes the initial installation much easier. Examples of suitable materials include, but are not limited to, Triple T by Thermal Ceramics and Organically Bound Maftec (OBM Maftec) distributed by Thermal Ceramics of Atlanta, Ga., a division of Morgan Crucible. It was found that OBM Maftec is preferable since it held together better after being exposed to high temperatures. OBM Maftec is produced from high quality mullite fiber. This material is known to possess low thermal conductivity and heat storage and is resistant to thermal shock and chemical attack. It additionally is highly flexible, has a maximum temperature rating of 2900° F. and a continuous use limit of up to 2700° F., making it ideal for this application. While the Triple T material expands more than the Maftec, it was found to flake apart more easily after heating.

A sight and lighting port 50 is provided in the burner plenum 48, both to allow inspection of the interior of the burner assembly, and to provide access for lighting of the burner through lighting chamber 60. As shown, the sight and lighting port 50 is aligned with lighting chamber 60, which is adjacent to the first opening in the furnace. Lighting chamber 60 is located at a distance from burner tip 20 effective for burner light off. A lighting torch or igniter (not shown) of the type disclosed in U.S. Pat. No. 5,092,761 has utility in the start-up of the burner of the present invention, as those skilled in the art will readily understand. To operate the burner of the present invention, the torch or igniter is inserted through light-off tube 50 into the lighting chamber 60, which is adjacent burner tip 20, to light the burner.

Figure 5:
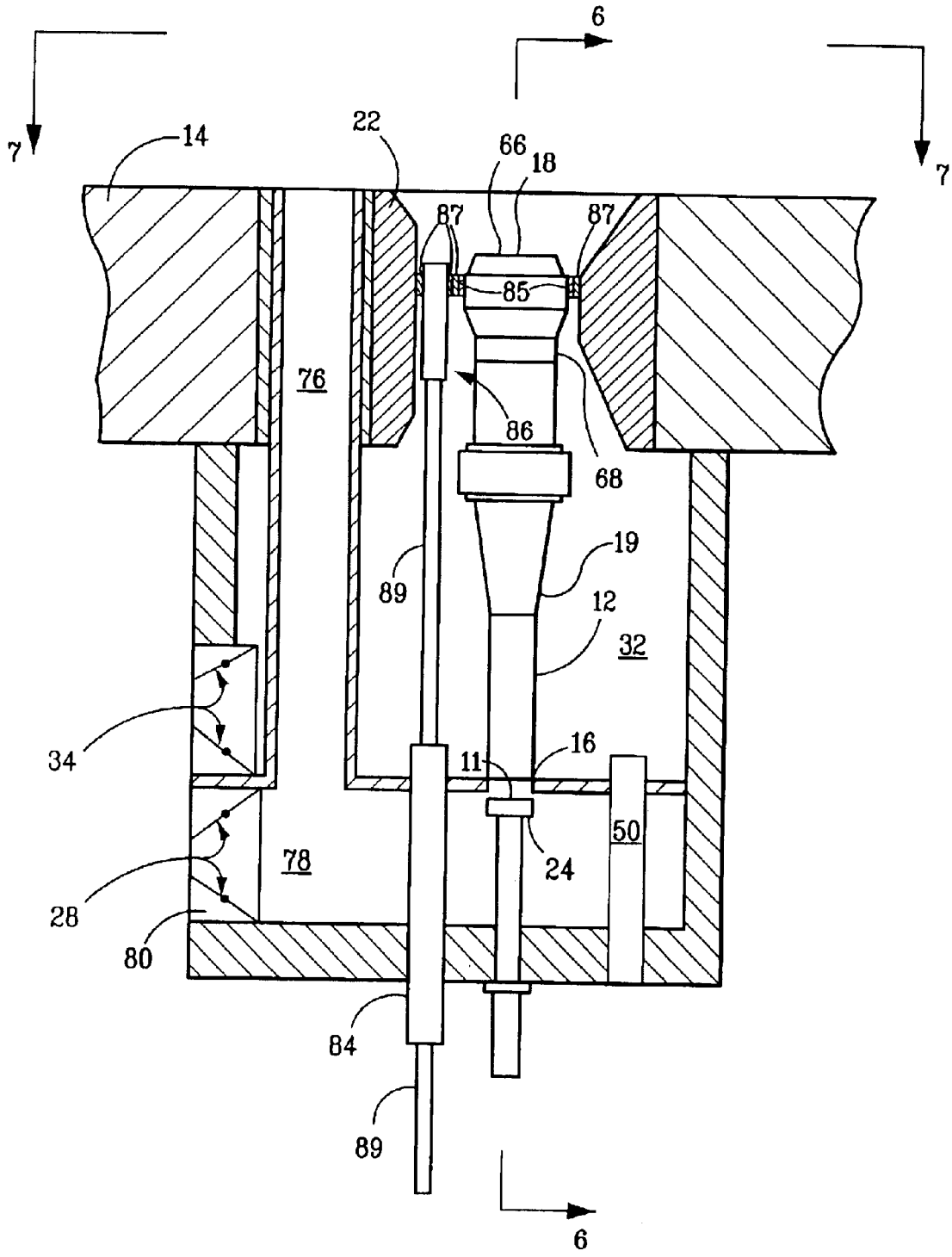
FIG. 5 is an elevation partly in section of a second embodiment of the burner of the present invention.
Figure 6:
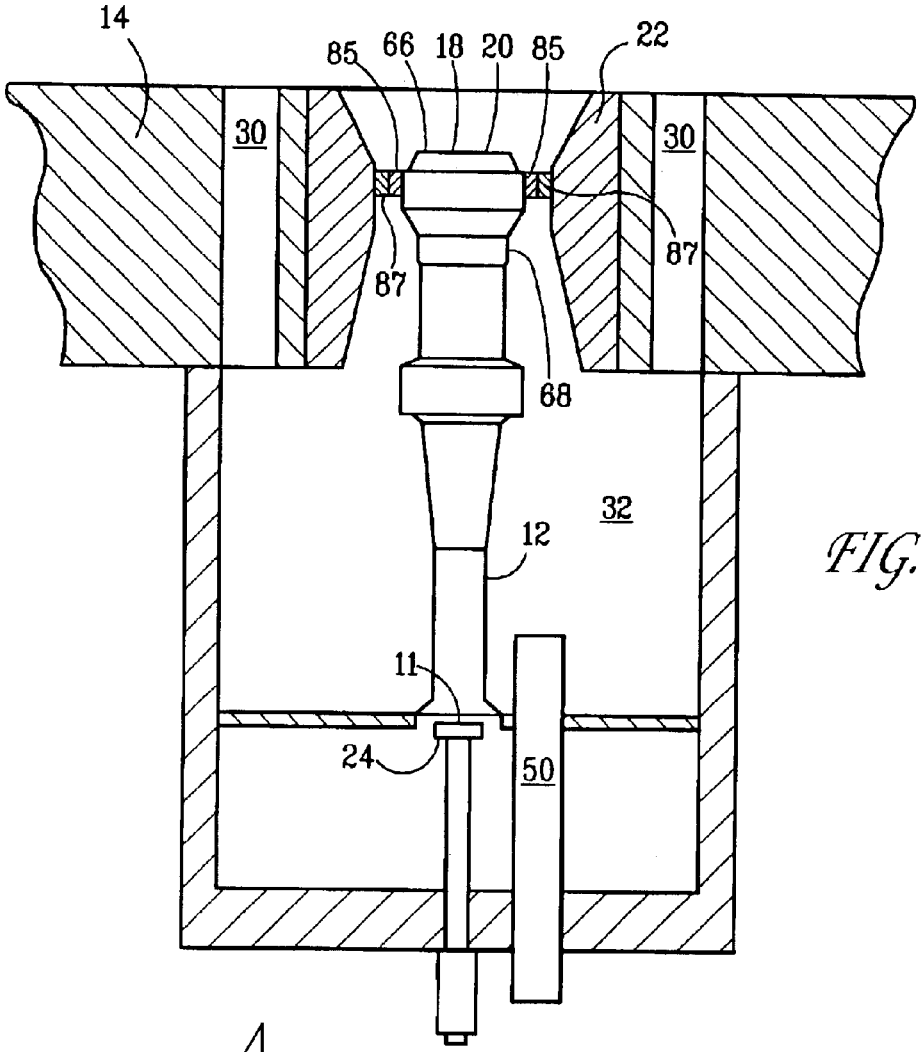
FIG. 6 is an elevation partly in section taken along line 6—6 of FIG. 5.
Figure 7:
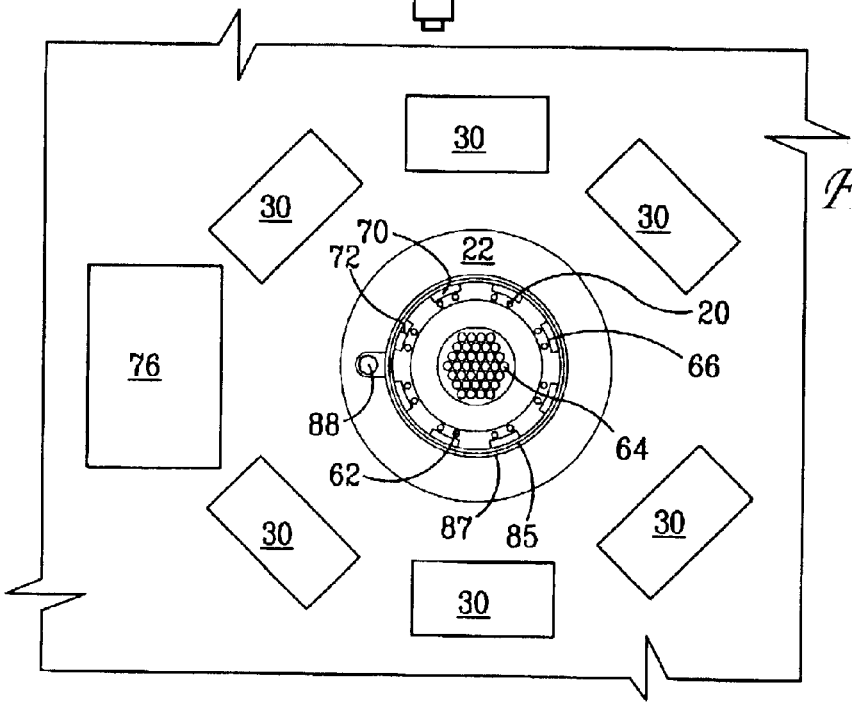
FIG. 7 is a plan view taken along line 7—7 of FIG. 5.
Figure 8A:
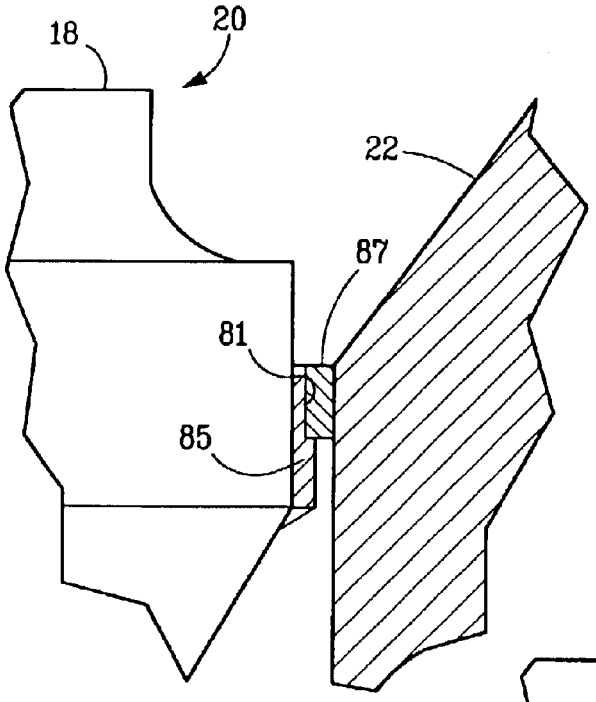
FIG. 8A is an exploded view of one embodiment of a burner tip seal.
Figure 8B:
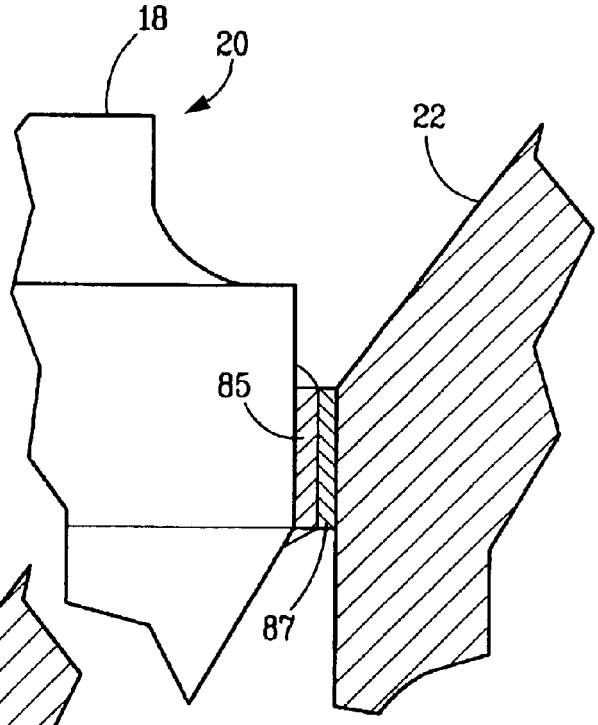
FIG. 8B is an exploded view of another embodiment of a burner tip seal.
Figure 8C:
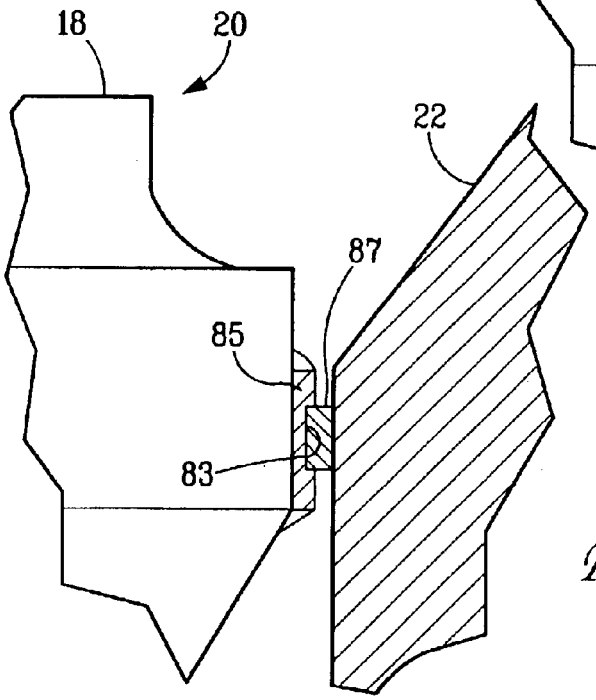
FIG. 8C is an exploded view of yet another embodiment of a burner tip seal.

The burner tip of the present invention may also be used in a low $NO_x$ burner design of the type illustrated in FIGS. 5, 6 and 7, wherein like reference numbers indicate like parts. As with the embodiment of FIGS. 1 through 4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by a peripheral tile 22. Gas spud 24 is located at upstream end 16 and introduces fuel gas into burner tube 12. Fresh or ambient air is introduced into primary air chamber 78 through adjustable damper 28 to mix with the fuel gas at upstream end 16 of burner tube 12. Combustion of the fuel gas and fresh air occurs downstream of burner tip 20.

As with the burner design illustrated in FIGS. 1 through 4, the burner of FIGS. 5 through 7 has a burner tip 20 which has an upper end 66, which when installed, faces the furnace box, and a lower end 68 adapted for mating with the burner tube 12. As previously described, lower end 68 of burner tip 20 may be mated to burner tube 12 by welding, swaging or threaded engagement, with welding or threaded engagement being particularly preferred. In operation, side-ports 62 direct a fraction of the fuel gas across the face of peripheral tile 22, while main ports 64 direct the major portion of the fuel gas into the furnace.

A plurality of air ports 30 originates in secondary air chamber 32 and pass through furnace floor 14 into the furnace. Fresh air enters secondary air chamber 32 through adjustable dampers 34 and passes through staged air ports 30 into the furnace to provide secondary or staged combustion.

In order to recirculate flue gas from the furnace to the primary air chamber, a flue gas recirculation passageway 76 is formed in furnace floor 14 and extends to primary air chamber 78, so that flue gas is mixed with fresh air drawn into the primary air chamber from opening 80. Flue gas containing, for example, about 6–10% $O_2$ is drawn through passageway 76 by the inspirating effect of fuel gas passing through venturi portion 19 of burner tube 12. As with the embodiment of FIGS. 1 through 4, the primary air and flue gas are mixed in primary air chamber 78, which is prior to the zone of combustion. Closing or partially closing damper 28 restricts the amount of fresh air that can be drawn into the primary air chamber 26 and thereby provides the vacuum necessary to draw flue gas from the furnace floor 14.

As with the embodiment of FIGS. 1 through 4, a mixture of approximately 50% flue gas and approximately 50% ambient air is drawn through flue gas recirculation passageway 76. The desired proportions of flue gas and ambient air may be achieved by proper sizing, placement and/or design of flue gas recirculation passageway 76 and air ports 30; that is, the geometry and location of the air ports may be varied to obtain the desired percentages of flue gas and ambient air.

Sight and lighting port 50 provides access to the interior of secondary air chamber 32 for a lighting torch or igniter (not shown). As with the embodiment of present invention depicted in FIGS. 1 through 4, a lighting torch or igniter of the type disclosed in U.S. Pat. No. 5,092,761 has utility in this embodiment of the present invention. Sight and lighting port 50 allows inspection of the interior of the burner assembly and access for lighting of the burner through lighting chamber 60. Sight and lighting port 50 is aligned with lighting chamber 60, which is adjacent to the first opening in the furnace. Lighting chamber 60 is located at a distance from burner tip 20 effective for burner light-off. Referring to FIG. 5, a tube 84 provides access to the interior of secondary air chamber 32 for an optional pilot 86.

To operate the burner of FIGS. 5 through 7, a torch or igniter is inserted through light-off tube 50 into the lighting chamber 60, which is adjacent primary combustion area and burner tip 20, to light the burner. In operation, a fuel orifice 11, which may be located within gas spud 24, discharges fuel into burner tube 12, where it mixes with primary air, recirculated flue-gas or a mixture of primary air and recirculated flue-gas. The mixture of fuel gas and air, flue gas or mixtures thereof then discharges from burner tip 20. The mixture in the venturi portion 19 of burner tube 12 is maintained below the fuel-rich flammability limit; i.e. there is insufficient air in the venturi to support combustion. Staged, secondary air is added to provide the remainder of the air required for combustion. The majority of the staged air is added a finite distance away from the burner tip 20 through staged air ports 30. However, as with the design of FIGS. 1–4, a portion of the staged, secondary air passes between the burner tip 20 and the peripheral tile 22 through a plurality of air gaps 70 and is immediately available to the fuel exiting the side ports 62 of burner tip 20. Side-ports 62 direct a fraction of the fuel across the face of the peripheral tile 22, while main ports 64 of burner tip 20, direct the major portion of the fuel into the furnace.

As may be envisioned, two combustion zones are established. A small combustion zone is established across the face of the peripheral tile 22, emanating from the fuel gas combusted in the region of the side-ports 62, while a much larger combustion zone is established projecting into the furnace firebox, emanating from the fuel gas combusted from the main ports 64. In operation, the larger combustion zone represents an approximately cylindrical face of combustion extending up from the burner, where the staged air flowing primarily from air ports 30 meets the fuel-rich mixture exiting from the burner tip main ports 64.

Analysis of burner performance has shown that the combustion zone adjacent to the side ports 62 and peripheral tile 22 is important in assuring flame stability. To provide adequate flame stability, the air/fuel mixture in this zone, which comprises the air/fuel mixture leaving the side ports 62 of burner tip 20, plus the air passing between the burner tip 20 and the peripheral tile 22 through a plurality of air gaps 70, must be above the fuel-rich flammability limit.

While a mixture above the fuel-rich flammability limit in the combustion zone adjacent to the side ports 62 and peripheral tile 22 assures good burner stability, combustion in this zone has been found to generate relatively high $NO_x$ levels compared to the larger combustion zone. To achieve lower $NO_x$ levels it is important that the air flow between burner tip 20 and the peripheral tile 22 be such that combustion takes place within this zone with a mixture sufficiently far above the fuel-rich flammability limit to assure good burner stability, but without the high oxygen concentrations that lead to high $NO_x$ emissions.

As is shown in FIGS. 5–7, and in more detail in FIG. 12A, a very small gap exists between the burner tip 20 and the burner tile 22. As previously described, by keeping this gap small, the bulk of the secondary staged air is forced to enter the furnace through staged air ports 30 located some distance from the primary combustion zone, which is located immediately on the furnace side of the burner tip 20. While this gap may be a substantially peripheral gap, it preferably comprises a series of spaced gaps 70 peripherally arranged, as shown in FIG. 12A.

The previously described configurations depicted in FIGS. 8A–C and 12A may advantageously be employed in the burner design of FIGS. 5–7. As with the burner of FIGS. 1–4, to establish a uniform dimension between the burner tip 20 and the peripheral burner tile 22 for the air gaps 70, a burner tip band 85, may be formed of steel or other metal or metallic-composite capable of withstanding the harsh environment of an industrial burner and attached to the outer periphery of burner tip 20, by tack welding or other suitable means. A compressible high temperature material 87 is optionally employed in the unwanted gap between the burner tip band 85 and the peripheral tile 22 to further reduce or eliminate the gap. Compressible material 87 may be selected from any of the materials previously described or their equivalents.

Figure 9:
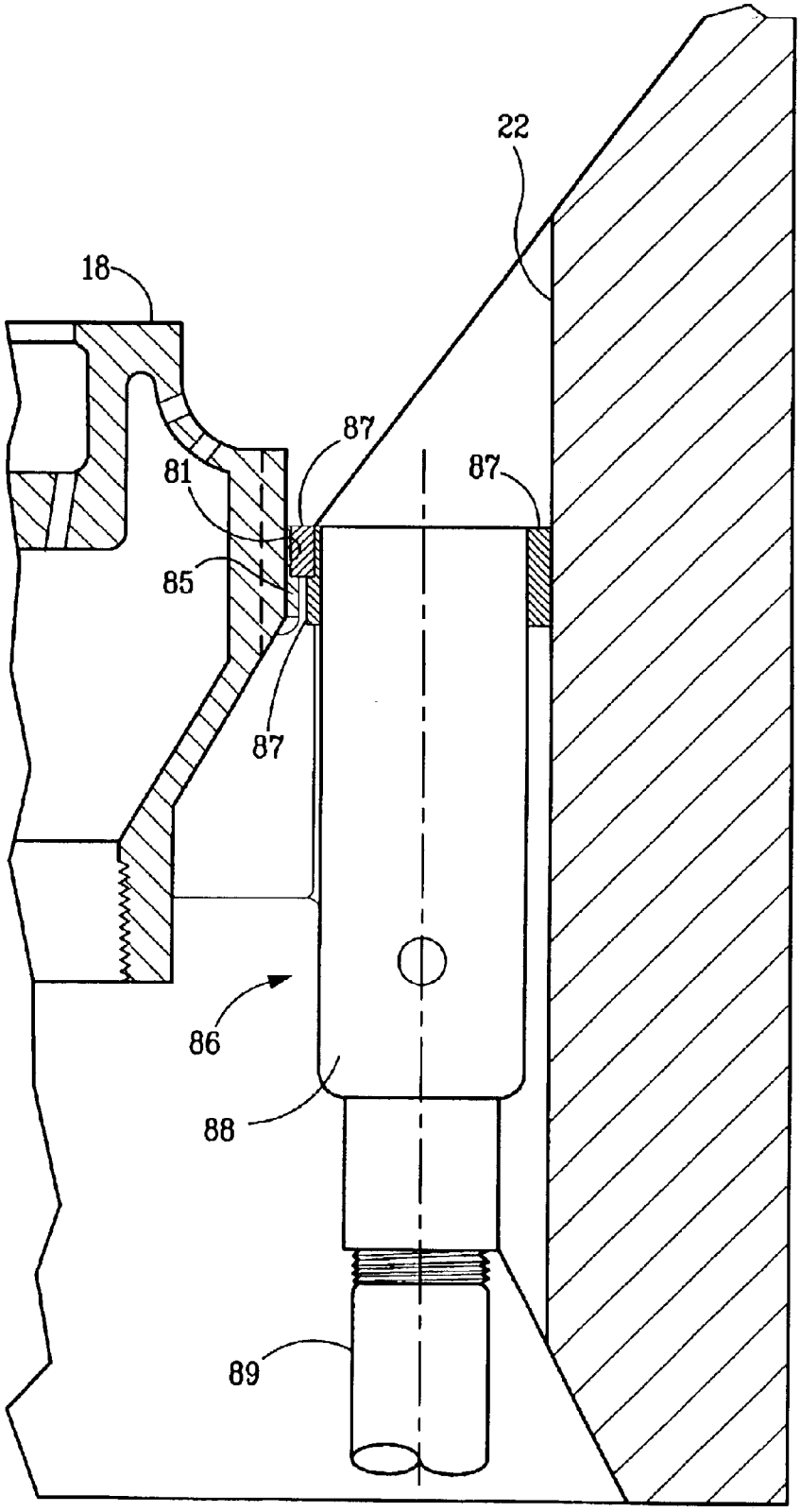
FIG. 9 illustrates an embodiment of a seal means for sealing in the region of the pilot chamber.

Referring now to FIG. 9, a similar benefit may be obtained in the region of pilot 86, adjacent to the first opening in the furnace. It has been observed that significant leakage occurs in typical designs due to gaps existing around the pilot shield 88. To remedy this, a compressible high temperature material 87 is installed around the pilot shield 88, and/or pilot riser 89 to eliminate the unwanted gap between the burner tip band 85 and the peripheral tile 22, as shown in FIG. 9. For example, it has been found that a one inch wide by 0.1875 inch thick strip of OBM Maftec works particularly well to seal gaps existing around the pilot shield 88.

Figure 10:
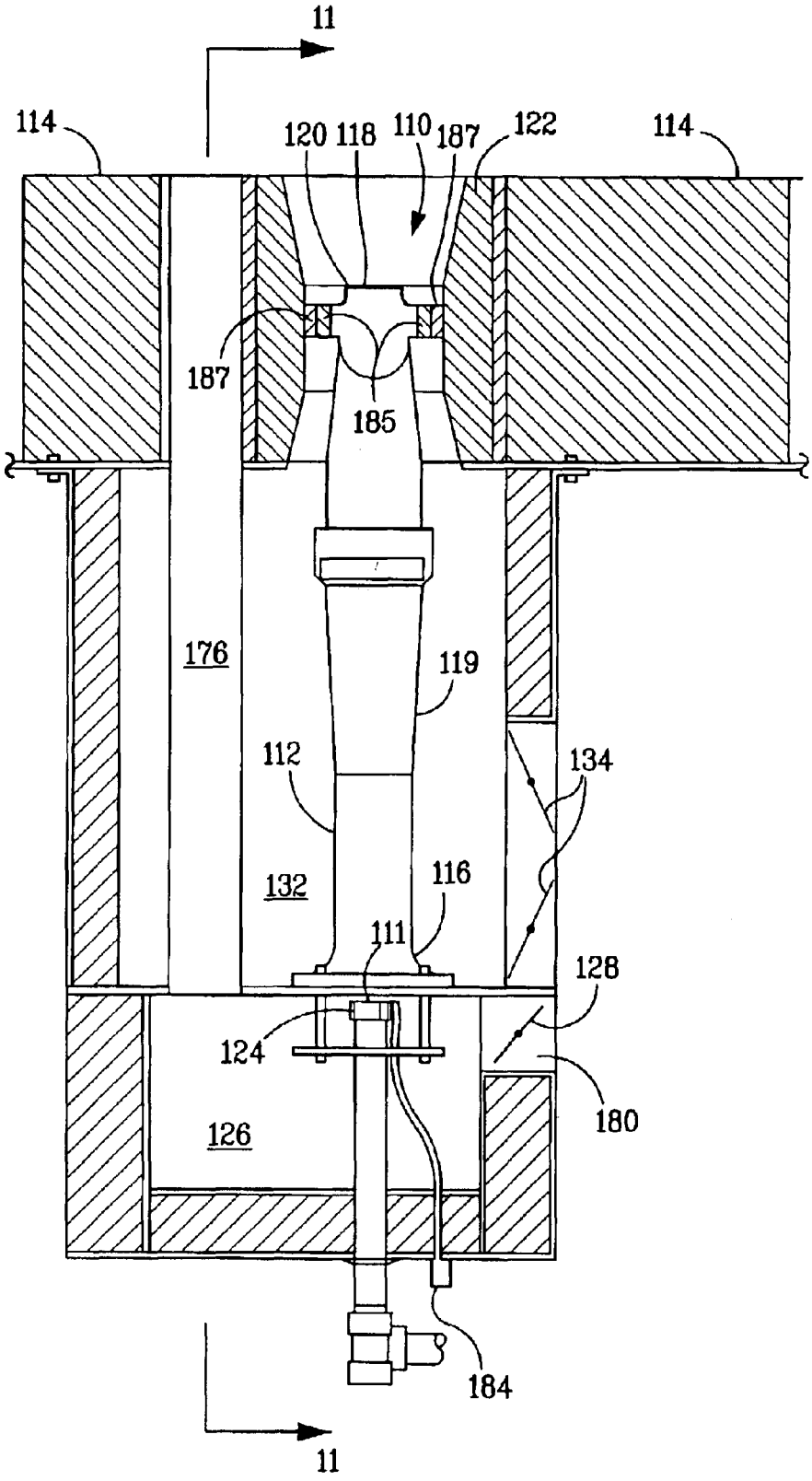
FIG. 10 is an elevation partly in section of the embodiment of a flat-flame burner.
Figure 11:
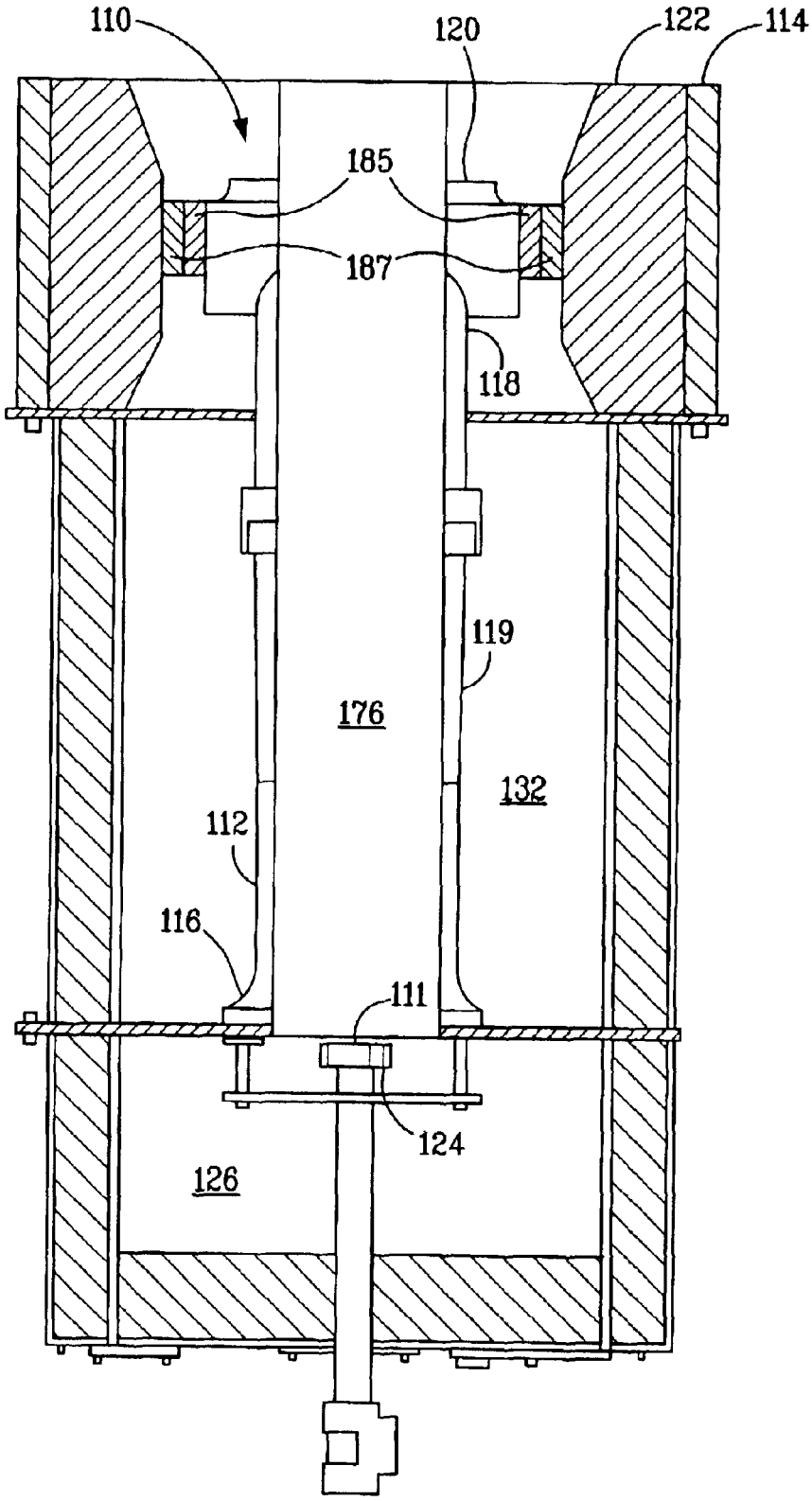
FIG. 11 is an elevation partly in section of the embodiment of a flat-flame burner of FIG. 10 taken along line 11—11 of FIG. 10.

A similar benefit can be achieved in flat-flame burners, as will now be described by reference to FIGS. 10, 11 and 12B. A premix burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within gas spud 124, is located at upstream end 116 and introduces fuel gas into burner tube 112. Fresh or ambient air is introduced into primary air chamber 126 to mix with the fuel gas at upstream end 116 of burner tube 112. Combustion of the fuel gas and fresh or ambient air occurs downstream of burner tip 120. Fresh or ambient secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180 through dampers 128. Flue gas containing, for example, 0 to about 15% $O_2$ is drawn through passageway 176 by the inspirating effect of fuel gas passing through venturi portion 119 of burner tube 112. Primary air and flue gas are mixed in primary air chamber 126, which is prior to the zone of combustion.

Figure 12B:
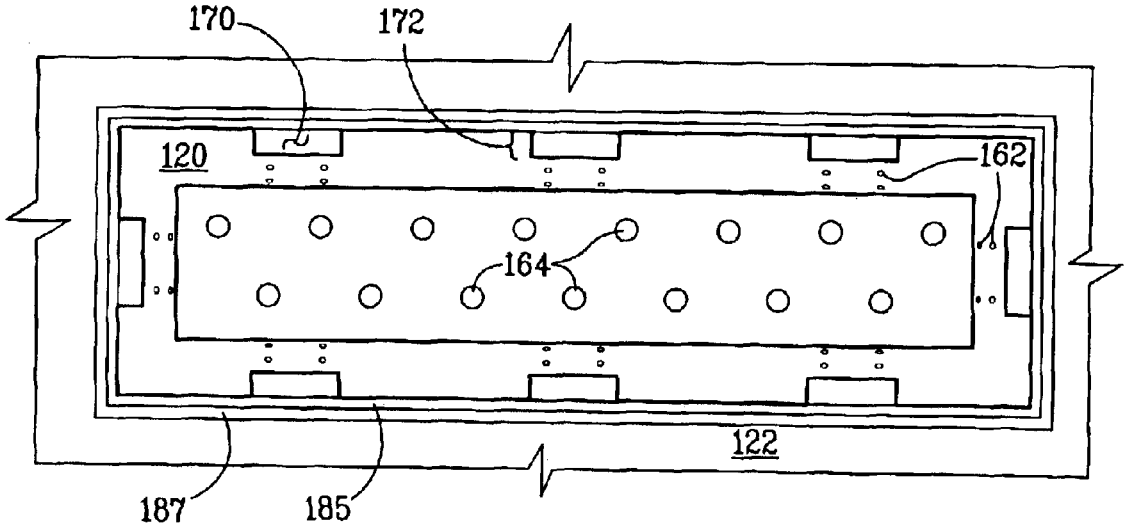
FIG. 12B is a top view of another embodiment of a burner tip seal for use in a flat-flame burner.

As is shown in FIG. 12B, a plurality of air gaps 170 exist between the burner tip 120 and the burner tile 122. By properly engineering these gaps, the bulk of the secondary staged air is forced to enter the furnace through staged air ports (not shown) located some distance from the primary combustion zone, which is located immediately on the furnace side of the burner tip 120. These gaps may be a series of spaced gaps peripherally arranged, as shown.

In operation, gas spud 124 discharges fuel into burner tube 112, where it mixes with primary air and recirculated flue-gas. The mixture of fuel gas, recirculated flue-gas and primary air then discharges from burner tip 120. The mixture in the venturi portion 119 of burner tube 112 is maintained below the fuel-rich flammability limit; i.e. there is insufficient air in the venturi to support combustion. Staged, secondary air is added to provide the remainder of the air required for combustion. The majority of the staged air is added a finite distance away from the burner tip 120 through staged air ports (not shown). However, a portion of the staged, secondary air passes between the burner tip 120 and the peripheral tile 122 and is immediately available to the fuel exiting the side ports 162. As indicated, side-ports 162 direct a fraction of the fuel across the face of the peripheral tile 122, while main ports 164, direct the major portion of the fuel into the furnace.

Again, two combustion zones are established. A small combustion zone is established across the face of the peripheral tile 122, emanating from the fuel gas combusted in the region of the side-ports 162, while a much larger combustion zone is established projecting into the furnace firebox, emanating from the fuel gas combusted from the main ports 164. The combustion zone adjacent to the side ports 162 and peripheral tile 122 is important in assuring flame stability. To provide adequate flame stability, the air/fuel mixture in this zone, which comprises the air/fuel mixture leaving the side ports 162 of burner tip 120, plus the air passing between the burner tip 120 and the peripheral tile 122, must be above the fuel-rich flammability limit.

While a mixture above the fuel-rich flammability limit in the combustion zone adjacent to the side ports 162 and peripheral tile 122 assures good burner stability, combustion in this zone will generate relatively high $NO_x$ levels compared to the larger combustion zone. Overall $NO_x$ emissions may be reduced by minimizing the proportion of fuel that is combusted in this smaller combustion zone. This is achieved by assuring that the air flow between burner tip 120 and the peripheral tile 122 is such that combustion takes place within this zone with a mixture sufficiently above the fuel-rich flammability limit to assure good burner stability, but without the high oxygen concentrations that lead to high $NO_x$ emissions.

Referring now to FIG. 12B, to establish a uniform dimension between the burner tip 120 and the peripheral burner tile 122 for the air gaps 170, a burner tip band 185, may be formed of steel or other metal or metallic-composite capable of withstanding the harsh environment of an industrial burner and attached to the outer periphery of burner tip 120, by tack welding or other suitable means. A compressible high temperature material 187 is optionally employed in the unwanted gap between the burner tip band 185 and the peripheral tile 122 to further reduce or eliminate the gap. Compressible material 187 may be selected from any of the materials previously described or their equivalents.

Unlike prior designs, use of the burner tip seal of the present invention serves to substantially minimize localized sources of high $NO_x$ emissions in the region near the burner tip.

It is to be understood that the burner tip seal designs described herein also have utility in raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

In addition to the use of flue gas as a diluent, another technique to achieve lower flame temperature through dilution is through the use of steam injection. (See steam injection tube 15 of FIG. 2 and steam injection tube 184 of FIG. 10). Steam can be injected in the primary air or the secondary air chamber. Preferably, steam may be injected upstream of the venturi.

As may be appreciated by those skilled in the art, the present invention can be incorporated in new burners or can be retrofitted into existing burners.

Although illustrative embodiments have been shown and described, a wide range of modification change and substitution is contemplated in the foregoing disclosure and in some instances, some features of the embodiment may be employed without a corresponding use of other features. Accordingly, it is appropriate that the appended claims be construed broadly and in a manner consistent with the scope of the embodiments disclosed herein.

What is claimed is:

1. A burner for the combustion of fuel in a furnace, said burner comprising:

(a) a burner tube having a downstream end and an upstream end for receiving fuel and air, flue gas or mixtures thereof;

(b) a fuel orifice located adjacent the upstream end of said burner tube, for introducing fuel into said burner tube;

(c) a burner tip mounted on the downstream end of said burner tube and adjacent a first opening in the furnace, said burner tip having a plurality of air flow notches positioned about an outer periphery thereof;

(d) a peripheral tile surrounding said outer periphery of said burner tip, forming said first opening in the furnace; and (e) a burner tip seal in contact with at least a portion of said outer periphery of said burner tip and said peripheral tile;

wherein a plurality of air gaps is formed between an inner periphery of said burner tip seal and said air flow notches, said plurality of air gaps effective for providing a portion of the air for combustion.

2. The burner of claim 1, wherein said burner tip seal comprises a burner tip band, said burner tip band comprised of steel, metal or metal composites capable of withstanding the harsh environment of an industrial burner.

3. The burner of claim 2, wherein said burner tip band is comprised of steel.

4. The burner of claim 2, further comprising a compressible high temperature material positioned about an outer periphery of said burner tip band, wherein said compressible material is in sealing engagement with said peripheral tile.

5. The burner of claim 4, wherein said burner tip band further comprises a peripheral indentation for seating said compressible high temperature material.

6. The burner of claim 4, wherein said compressible high temperature material expands when heated.

7. The burner of claim 6, wherein said compressible high temperature material is produced from mullite fiber.

8. The burner of claim 4, wherein said compressible high temperature material has a maximum temperature rating of 2900° F. and a continuous use limit of up to 2700° F.

9. The burner of claim 1, wherein the fuel orifice is located within a gas spud located adjacent the upstream end of said burner tube, for introducing fuel gas into said burner tube.

10. The burner of claim 1, wherein the fuel is fuel gas and said burner tip has a plurality of main ports and a plurality of peripherally arranged side ports.

11. The burner of claim 1, further comprising at least one steam injection tube for injecting steam upstream of said burner tube.

12. The burner of claim 1, wherein said burner is a flat-flame burner.

13. The burner of claim 1, wherein said burner is a pre-mix burner.

14. A method for combusting fuel in a burner installed in a furnace, comprising the steps of:

(a) combining fuel and air, flue gas or mixtures thereof at a predetermined location adjacent a fuel orifice;

(b) passing the fuel and air, flue gas or mixtures thereof through a burner tube;

(c) discharging the fuel gas and air, flue gas or mixtures thereof at a burner tip downstream of the predetermined location, the burner tip having a plurality of air flow notches positioned about an outer periphery thereof, the burner tip peripherally surrounded by a peripheral tile; and (d) sealing the outer periphery of the burner tip with a burner tip seal, the burner tip seal in sealing engagement with at least a portion of the outer periphery of the burner tip and the peripheral tile;

(e) combusting said fuel gas downstream of the burner tip downstream of said predetermined location;

wherein a plurality of air gaps are formed between an inner periphery of the burner tip seal and the air flow notches, the plurality of air gaps effective for providing a portion of the air for combustion.

15. The method of claim 14, wherein the burner tip seal comprises a burner tip band, the burner tip band comprised of steel, metal or metal composites capable of withstanding the harsh environment of an industrial burner.

16. The method of claim 15, wherein the burner tip band is comprised of steel.

17. The method of claim 15, further comprising the step of further sealing the outer periphery of the burner tip with a compressible high temperature material positioned about an outer periphery of the burner tip band, wherein the compressible material is in sealing engagement with the peripheral tile.

18. The method of claim 17, wherein the burner tip band further comprises a peripheral indentation for seating the compressible high temperature material.

19. The method of claim 17, wherein the compressible high temperature material expands when heated.

20. The method of claim 17, wherein the compressible high temperature material is produced from mullite fiber.

21. The method of claim 17, wherein the compressible high temperature material has a maximum temperature rating of 2900° F. and a continuous use limit of up to 2700° F.

22. The method of claim 14, wherein the fuel orifice is located within a gas spud for introducing fuel gas into the burner tube.

23. The method according to claim 14, further comprising the step of drawing a stream of flue gas from the furnace.

24. The method according to claim 23, wherein the stream of flue gas drawn from the furnace is drawn in response to the inspirating effect of uncombusted fuel gas exiting the fuel orifice and flowing towards said combustion zone.

25. The method according to claim 23, wherein said drawing step includes passing the fuel gas and air, flue gas or mixtures thereof; through a venturi, whereby the inspirating effect of the uncombusted fuel gas exiting the fuel orifice and flowing through said venturi draws the flue gas into the venturi.

26. The method of claim 14, further comprising the step of injecting steam upstream of the burner tube.

27. The method according to claim 14, wherein the burner is a pre-mix burner.

28. The method according to claim 14, wherein the burner is a flat-flame burner.

29. The method according to claim 14, wherein the burner is installed in a steam-cracking furnace.

* * * * *